US007236568B2

(12) United States Patent
Dinsmore et al.

(10) Patent No.: US 7,236,568 B2
(45) **Date of Patent: *Jun. 26, 2007**

(54) MINIATURE X-RAY SOURCE WITH IMPROVED OUTPUT STABILITY AND VOLTAGE STANDOFF

(75) Inventors: Mark T. Dinsmore, Sudbury, MA (US); David J. Caruso, Groton, MA (US)

(73) Assignee: twX, LLC, Groton, MA (US)

( * ) Notice: Subject to any disclaimer, the term of this patent is extended or adjusted under 35 U.S.C. 154(b) by 84 days.

This patent is subject to a terminal disclaimer.

(21) Appl. No.: 11/087,271

(22) Filed: Mar. 23, 2005

(65) Prior Publication Data

US 2005/0213709 A1 Sep. 29, 2005

Related U.S. Application Data

(60) Provisional application No. 60/555,570, filed on Mar. 23, 2004.

(51) Int. Cl.
*H01J 35/02* (2006.01)

(52) U.S. Cl. ..... 378/139; 378/119; 378/121

(58) Field of Classification Search ..... 378/101, 378/102, 111, 112, 119, 121, 139, 140; 600/427
See application file for complete search history.

(56) References Cited

U.S. PATENT DOCUMENTS 5,153,900 A * 10/1992 Nomikos et al. ..... 378/65
6,480,568 B1 11/2002 Dinsmore ..... 378/65
6,480,573 B1 11/2002 Dinsmore ..... 378/136

(Continued)

OTHER PUBLICATIONS

Summary Session III: Secondary Emission, Surface Effects and Coatings (of talks on secondary electron emission, surface effects and coatings given at the 8th ICFA Beam Dynamics Mini-Workshop on Two-Stream Instabilities in Particle Accelerators and Storage Rings, Santa Fe, NM, Feb. 16-18, 2000) prepared by Oswald Gröbner, Apr. 25, 2000 available at www.aps.anl.gov/News/Conferences/ 2000/icfa/papers/grobner-sum.pdf.

U.S. Appl. No. 60/555,570, filed Mar. 23, 2004, and entitled Miniature X-ray Source With Increased Output Stability and High Voltage Capacity.

*Primary Examiner*—Edward J. Glick
*Assistant Examiner*—Jurie Yun
(74) *Attorney, Agent, or Firm*—Burns & Levinson LLP; Orlando Lopez; David W. Gomes

(57) ABSTRACT

An x-ray source includes an insulating tube having a cylindrical inside surface defining a cylindrical vacuum cavity, a cathode located near a first end of the insulating tube and adapted to be optically heated for emitting electrons, an anode adapted for a voltage bias with respect to the cathode for accelerating electrons emitted from the cathode, an x-ray emitter target located near a second end of the insulating tube for impact by accelerated electrons, and a secondary emission reduction layer covering at least a portion of the inside surface and adapted to minimize charge build-up on the inside surface, wherein the insulating tube is adapted to be weakly conductive to support a uniform voltage gradient along the insulating tube and across the voltage bias between the cathode and the anode.

21 Claims, 3 Drawing Sheets

U.S. PATENT DOCUMENTS

| | | | | |
|---|---|---|---|---|
| 6,493,419 | B1 | 12/2002 | Dinsmore | 378/65 |
| 6,556,651 | B1 | 4/2003 | Thomson et al. | 378/65 |
| 6,658,086 | B2 | 12/2003 | Dinsmore | 378/65 |
| 6,721,392 | B1 | 4/2004 | Dinsmore | 378/65 |
| 6,771,737 | B2 * | 8/2004 | Kerslick et al. | 378/122 |
| 2002/0191746 | A1 | 12/2002 | Dinsmore | 378/119 |

* cited by examiner

MINIATURE X-RAY SOURCE WITH IMPROVED OUTPUT STABILITY AND VOLTAGE STANDOFF

RELATED APPLICATIONS

The present application claims priority for U.S. Provisional Patent Application Ser. No. 60/555,570, filed Mar. 23, 2004, and entitled MINIATURE X-RAY SOURCE WITH IMPROVED OUTPUT STABILITY AND VOLTAGE.

FIELD OF THE INVENTION

The present invention generally relates to X-ray sources, and in particular to miniature X-ray sources.

BACKGROUND OF THE INVENTION

X-rays are widely used in materials analysis systems. For example, X-ray spectrometry is an economical technique for quantitatively analyzing the elemental composition of samples. The irradiation of a sample by high energy electrons, protons, or photons ionizes some of the atoms in the sample. These atoms emit characteristic X rays, whose wavelengths depend upon the atomic number of the atoms forming the sample, because X-ray photons typically come from tightly bound inner-shell electrons in the atoms. The intensity of the emitted X-ray spectra is related to the concentration of atoms within the sample.

Typically, the X-rays used for materials analysis are produced in an X-ray tube by accelerating electrons to a high velocity with an electro static field, and then suddenly stopping them by a collision with a solid target interposed in their path. The X-rays radiate in all directions from a spot on the target where the collisions take place. The X-rays are emitted due to the mutual interaction of the accelerated electrons with the electrons and the positively charged nuclei which constitute the atoms of the target. High-vacuum X-ray tubes typically include a thermionic cathode, and a solid target. Conventionally, the thermionic cathode is resistively heated, for example by heating a filament resistively with a current. Upon reaching a thermionic temperature, the cathode thermionically emits electrons into the vacuum. An accelerating electric field is established, which acts to accelerate electrons generated from the cathode toward the target. A high voltage source, such as a high voltage power supply, may be used to establish the accelerating electric field. In some cases the accelerating electric field may be established between the cathode and an intermediate gate electrode, such as an anode. In this configuration, a substantially field-free drift region is provided between the anode and the target. In some cases, the anode may also function as a target.

Unfortunately, resistively heated cathodes suffer several disadvantages. Thermal vaporization of the tube's coiled cathode filament is frequently responsible for tube failure. Also, the electric current used for heating is substantial and readily affects the electric field in front of the cathode where the electron stream is formed. This creates undesirable electron stream patterns which decrease the efficiency of the source. Generating and delivering the filament current to the source further creates challenges and potential interference with the high voltage source in miniaturized applications.

In the field of medicine and radiotherapy, an optically driven (i.e. Laser) therapeutic radiation source has been previously disclosed. This optically driven therapeutic radiation source uses a reduced-power, increased efficiency electron source, which generates electrons with minimal heat loss. With the optically driven thermionic emitter, electrons can be produced in a quantity sufficient to provide the electron current necessary for generating therapeutic radiation at the target, while significantly reducing power requirements.

For materials analysis systems, where output requirements are higher, there is a need for high-efficiency, miniaturized X-ray sources.

SUMMARY OF THE INVENTION

In one embodiment, the present invention provides an x-ray source, comprising an insulating tube having a cylindrical inside surface defining a cylindrical vacuum cavity, a cathode located near a first end of the insulating tube and adapted to be optically heated for emitting electrons, an anode adapted for a voltage bias with respect to the cathode for accelerating electrons emitted from the cathode, an x-ray emitter target located near a second end of the insulating tube for impact by accelerated electrons, and a secondary emission reduction layer covering at least a portion of the inside surface and adapted to minimize charge build-up on the inside surface, wherein the insulating tube is adapted to be weakly conductive to support a uniform voltage gradient along the insulating tube and across the voltage bias between the cathode and the anode.

The insulating tube may have a conductivity adapted to allow current flow along the tube of approximately ten percent of electron current flow between the cathode and anode under a maximum voltage bias there between.

The insulating tube may be adapted to be weakly conductive by having a lower resistance layer located between the insulating tube and the secondary emission reduction layer. The insulating tube may have a characteristic resistance with the lower resistance layer having a lower resistance than the characteristic resistance to support a sheet current for removing residual charge build-up on the inside surface. The insulating tube may be ceramic with the lower resistance layer having a resistance value which is scaled to allow a sheet current sufficient to remove residual charge build-up when operating at a desired voltage bias and beam current between the cathode and anode.

The lower resistance layer may include refractory oxides such as aluminum oxide, chromium oxide, titanium oxide, ruthenium oxide, and/or vanadium oxide.

The insulated tube may include a ceramic material formulated to be weakly conductive.

The secondary emission reduction layer may have a secondary emission coefficient of approximately unity. The secondary emission reduction layer may include oxides such as copper oxide, chromium oxide and/or silicon oxide.

The x-ray source may further comprise a first end cover affixed to the first end of the insulating tube and adapted for supporting a vacuum within the vacuum cavity, wherein the first end cover includes a transparent window for admitting optical energy into the vacuum cavity and on to the cathode. The x-ray source may still further comprise a fiber optic cable adapted for providing optical energy for heating the cathode, wherein the first end cover is adapted to removeably mount one end of the fiber optic cable in adjacent the transparent window for illuminating the cathode. The x-ray source may yet further comprise a laser diode light source coupled to another end of the fiber optic cable.

The x-ray source may further comprise a second end cover affixed to the second end of the insulating tube and adapted for supporting a vacuum within the vacuum cavity, wherein the second end cover includes a window that is transparent to x-ray energy emitted by the target.

The insulating tube and the first and second layers may be adapted to support a voltage potential between the anode and the cathode of at least 20 kV per centimeter along the insulating tube. They may also be adapted to support a voltage potential between the anode and the cathode of at least 50 kV.

The insulating tube may be less than 2 centimeters long. The target may be electrically isolated from the anode, allowing the anode to intercept and substantially reduce leakage currents, backscattered and field emitted currents.

The x-ray source may further comprise a voltage source having an elongated voltage multiplier adapted for producing an elevated output voltage for biasing the anode or the cathode, an elongated high resistance output divider mounted parallel to the voltage multiplier and connected for sampling the output voltage; and a control circuit adapted to produce an input voltage for the voltage multiplier in response to the output voltage sampled by the output resistor, wherein the control circuit is located proximal to a low voltage end of the voltage multiplier and output divider. The x-ray source may still further comprise a laser diode light source adapted to provide energy for heating the cathode; and a diode control circuit adapted to control energy produced by the diode and thereby control electron emissions from the cathode, wherein the laser diode and diode control circuit are located proximally to the low voltage end of the voltage multiplier.

The laser diode output is coupled to a fiber optic that conducts the optical power to the cathode while maintaining high voltage isolation. Use of the fiber optic allows the voltage multiplier and divider assembly to have a uniform voltage gradient along its length thereby enabling miniaturization without affecting reliability.

In another embodiment, an x-ray source comprises an insulating tube having a cylindrical inside surface defining a cylindrical vacuum cavity, a cathode located near a first end of said insulating tube and adapted to be optically heated for emitting electrons, an anode adapted for a voltage bias with respect to said cathode for accelerating electrons emitted from said cathode, an x-ray emitter target located near a second end of said insulating tube for impact by accelerated electrons, an elongated voltage multiplier adapted for producing an elevated output voltage for biasing said anode or said cathode, an elongated, high resistance output divider mounted adjacent and parallel to said voltage multiplier and connected for sampling said output voltage, and a control circuit adapted to produce an input voltage for said voltage multiplier in response to said output voltage sampled by said output divider, wherein said control circuit is located proximal to a low voltage end of said voltage multiplier and output divider.

BRIEF DESCRIPTION OF THE DRAWINGS

The present invention is illustratively shown and described in reference to the accompanying drawings, in which.

DETAILED DESCRIPTION OF THE DRAWINGS

Figure 1:
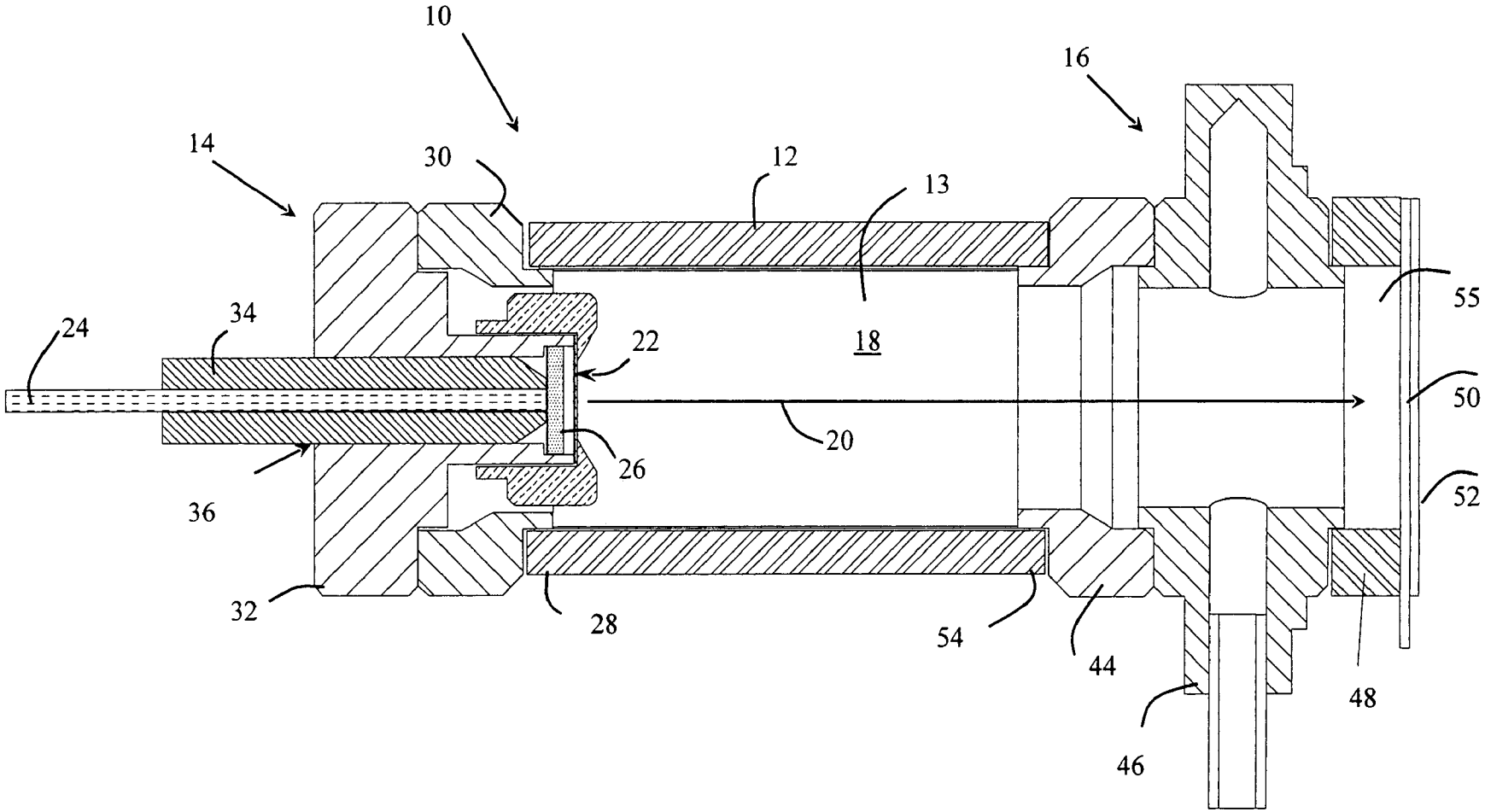
FIG. 1 is a cross-sectional view of an X-ray source constructed in accordance with one embodiment of the present invention.

FIG. 1 shows an X-ray source 10, which generally includes a central, cylindrical insulating tube 12, a cathode end cover assembly 14 and an anode end cover assembly 16. Ceramic tube 12 has an inside surface 13 defining a cylindrical vacuum cavity 18, through which an electron stream (or beam) 20 is accelerated under the influence of a bias voltage between a cathode 22 and an anode 46. Insulating tube 12 is constructed to be weakly conductive to support a uniform voltage gradient along tube 12. This uniform voltage gradient improves the characteristics of electron stream 20.

Cathode end cover assembly 14 functionally includes a cathode 22 designed to emit electrons when heated by optical laser energy. Also included is a transparent window 26 which allows laser energy from a fiber optic cable 24 into vacuum cavity 18 to illuminate and to heat cathode 22.

Cathode end cover assembly 14 further includes an outer collar 30 adapted for attachment to one end 28 of ceramic tube 12 by any suitable method to support a vacuum and an electrical connection thereto. One such method is brazing. Also included is an end piece 32, which is attached to outer collar 30 and has a concentric opening 36. Opening 36 provides removable mounting of cable 24 through the use of a ferule 34, which is carefully sized to frictionally fit into opening 36.

Figure 2:
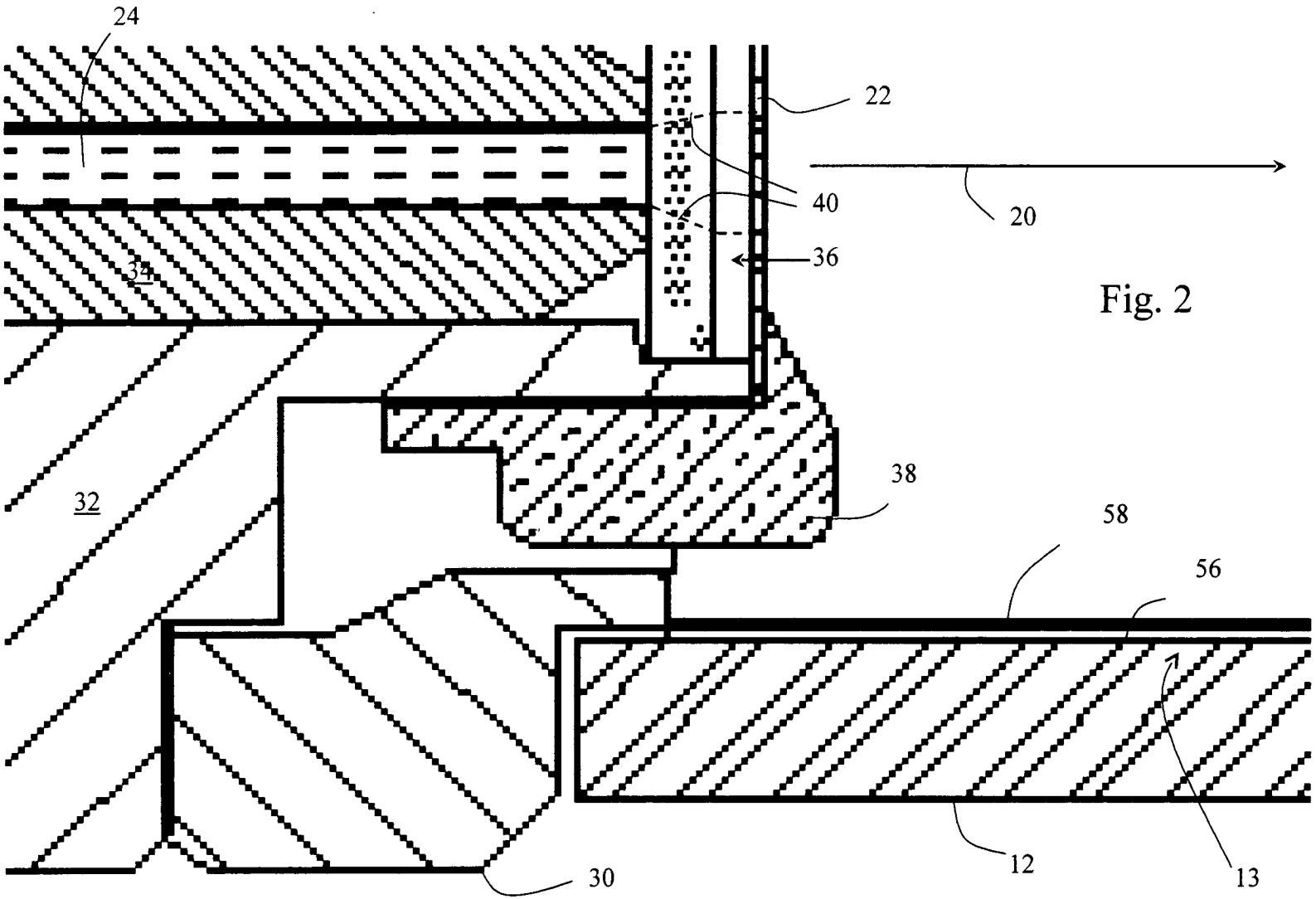
FIG. 2 is a close-up view the of a portion of the embodiment of FIG. 1.

Portions of cathode end cover assembly 14 are shown in greater detail in the enlarged view of FIG. 2. Fiber optic cable 24 is shown to simply abut one side of window 26, causing a slight spreading of energy reaching cathode 22, as represented by dotted lines 40.

Cathode end cover assembly 14 further includes an inner collar 38, which mounts cathode 22 on the end of concentric opening 36. The shape of inner collar 38 is such that it shapes the electrical field in front of cathode 22 as well as electron stream 20.

Cathode 22 is constructed in accordance with known techniques to limit heat loss from the central portion thereof to provide efficient heating and emission of an electron stream 20. Cathode 22 is preferably etched from foil, providing a very uniform mechanical assembly which is inherently low stress. It can handle the thermal transients with great reliability and can be much stronger than a helically wound electrically heated cathode. Additionally, the precision allowed by the etching process greatly improves the alignment of the cathode with the electron optics structure. This improves the accuracy and repeatability of the focusing and positioning of the electron beam, improving process yield and x-ray output stability. Such a cathode is intrinsically much stronger mechanically than other forms of thermionic cathodes, since it is etched from a monolithic, uniform sheet of material, and is mounted in a manner that does not disrupt its symmetry. Also, unlike conventional electrically heated cathodes, the laser heated cathode will not develop hot spots that accelerate evaporation of the cathode material and cause premature failure of the cathode.

In one embodiment, cathode 22 is preferably made of thoriated tungsten and may include a carbon coating to minimize light reflection. The planar nature of the cathode provides a homogeneous field at the emission region of the cathode, thus improving control of electron stream 20 and improving x-ray output stability.

Any suitable materials may be used to construct outer collar 30, end piece 32 and inner collar 38. In one embodiment; outer collar 30 is made of Kovar; end piece 32 is made of Kovar; and inner collar 38 is made of stainless steel.

Returning to FIG. 1, anode end cover assembly 14 is shown to include an outer collar 44, anode 46, an insulating collar 48, a target 50 and an X-ray transparent window 52. Outer collar 44 is adapted for attachment to the second end 54 of ceramic tube 12 by any suitable method, such as brazing, to support a vacuum therein and electrical connection thereto. Anode 46 is affixed to first collar 44 and insulating collar 48 is affixed to anode 46. Insulating collar 48 provides spacing 55 between anode 46 and target 50 in order to provide electrical isolation between anode 46 and target 50. Electrons striking target 50 cause the release of X-ray energy through window 52. Anode 44 intercepts and substantially reduces or eliminates leakage currents, back-scattered and field emitted currents. The accuracy of the target beam current measurement is thereby substantially increased.

Target 44 is a thin film transmission target comprised of the target material deposited on a thin window of radiation transparent material usually made of beryllium or beryllium oxide. The target material will be matched to the operating voltage and application (Ag, Au, Pt, W, etc.). The target can also be a bulk target, with the x-rays being emitted at an angle to the axis of the x-ray tube.

Any suitable materials may be used to construct outer collar 44, anode 46 and insulating collar 48. In one embodiment; outer collar 44 is made of Kovar; anode 46 is made of Kovar; and insulating collar 48 is made of ceramic.

Returning again to FIG. 2, inside surface 13 is shown to include a pair of layers 56, 58. Layer 56 has a substantially lower resistance than the ceramic material of tube 12 for the purpose of supporting a sheet current along inside surface 13. Lower resistance layer 56 produces a voltage gradient under voltage bias, which gradient is substantially uniform along the inside surface between the cathode 22 and anode 46. Lower resistance layer 56 extends in both directions to provide contact with and electrical connection to both outer collars 30, 44. The cathode/anode accelerating voltage bias is thusly applied to the ends of layer 56. Layer 56 is of a thickness sufficient to collect electrons with an energy equal to that of the accelerating voltage. The resistance of lower resistance layer 56, is designed to carry a current of approximately 10% (ten percent) of the total electron current which can be supported under the maximum bias conditions of source 10.

Any suitable material may be used for layer 56. In the preferred embodiment aluminum oxide, chromium oxide, titanium oxide, ruthenium oxide, and/or vanadium oxide may be used.

Alternatively, X-ray source 10 may be constructed without lower resistance layer 56, provided that the material used for tube 12 has an appropriate characteristic resistance to support a uniform voltage gradient under design operating conditions.

The second layer 58 is designed to reduce secondary emissions caused by electrons which bounce off of target 50 (FIG. 1) and return to the inside surface 13 of tube 12, or by electrons that are field emitted from the cathode region. The material used for secondary emission reduction layer 58 should have a coefficient of secondary emission which is close to unity. In a preferred embodiment, copper oxide, chromium oxide and/or silicon oxide are used.

Any suitable material may be used for insulating tube 12 to meet the operating criteria described herein. Insulating tube 12 is preferably made with a ceramic material.

During the operation of source 10, a voltage bias is connected between cathode end cover assembly 14 and anode end cover assembly 16, and that bias is connected there through to insulating tube 12 and/or lower resistance layer 56. The weakly conductive tube 12 or lower resistance layer 56 supports a current capable of preventing charge build-up on the inside surface 13 of tube 12 and the resulting distortion of electron stream 20. The planar shape of cathode 22, as well as the shape of inner collar 38 further serve to shape and focus both the electric field in front of cathode 22 and electron stream 20. Thus, electron stream (or beam) 20 is made more consistent, more reliable and more controllable.

By the use of both layers 56 and 58, most of the electrons which impact layer 58 cause the emission of the same number of electrons back into vacuum cavity 18. The few extra electrons which are emitted from layer 58 create some minor charges, which are swept away by the sheet current supported by lower resistance later 56.

The performance provided by this design is exceptional in terms of the voltage bias that can be handled by source 10. Useful, miniaturized sources can be constructed having an insulating tube 12 of less than 2 (two) centimeters in length, because a voltage bias of greater than 20 kV per centimeter is readily attainable. Further, a miniaturized source 10 may be easily constructed to handle a voltage bias of 50 kV, and even 100 kV is attainable.

Figure 3:
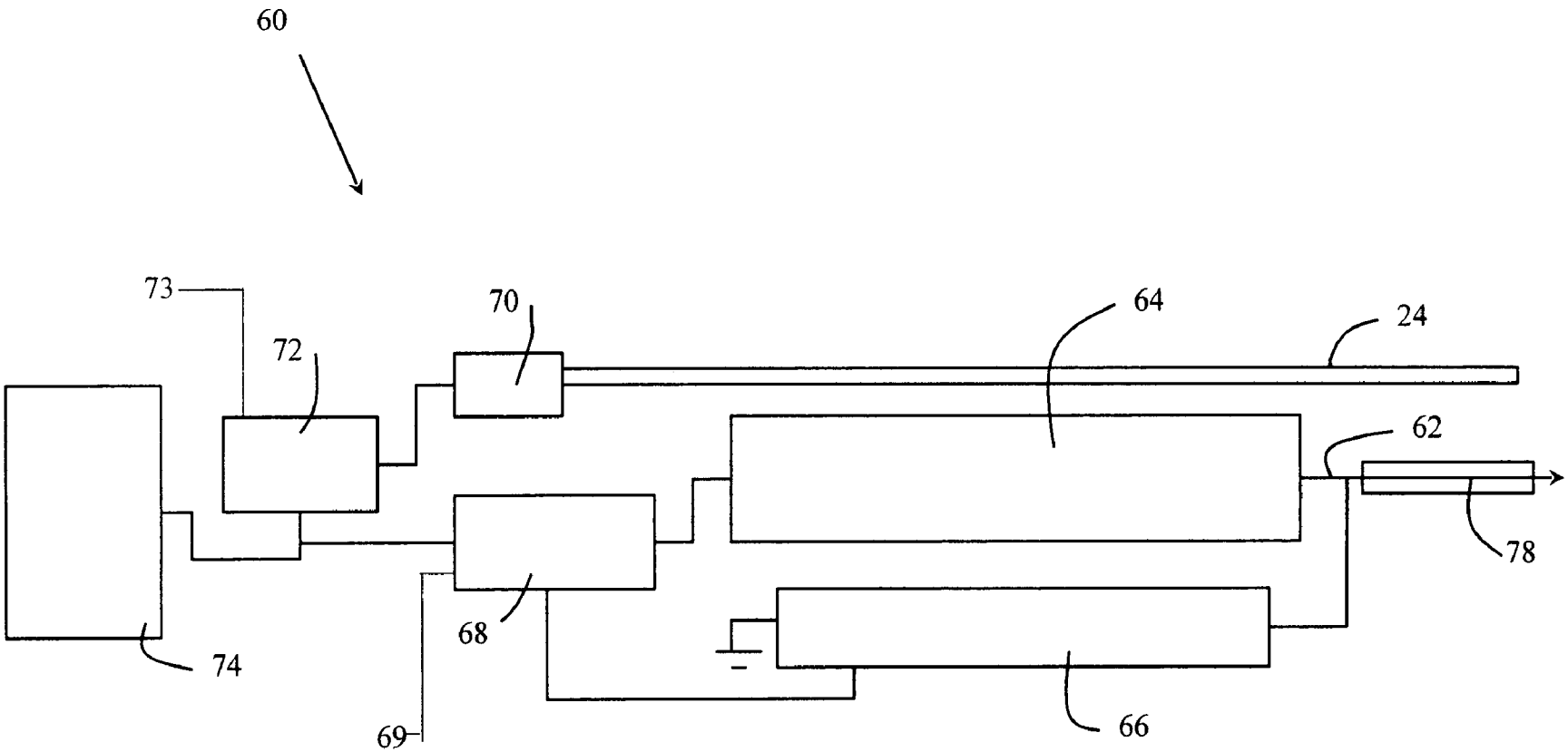
FIG. 3 is a block diagram of a circuit intended for use with the X-ray source of FIG. 1.

FIG. 3 is a circuit diagram of a power supply 60 for X-ray source 10 (FIGS. 1 and 2). A high voltage source 62 for biasing the anode 46 or cathode 22 includes a voltage multiplier 64, an elongated, high resistance output divider 66 and a voltage control circuit 68. The optical drive for fiber optic cable 24 is generated by laser diode 70 and controlled by diode control circuit 72. Voltage control circuit 68 and diode control circuit 72 include respective control inputs 69, 73 which enable selective control of voltage source 62 and the output of laser diode 70, respectively. Both high voltage source 62 and the optical output of diode 70 may be powered by a single power source 74.

Voltage multiplier 64 is elongated and includes a capacitor and diode network having a Cockcroft-Walton configuration. Elongated resistive output divider 66 is located parallel to and in general alignment with voltage multiplier 64 to minimize the voltage difference between the two devices at any point along their respective lengths. In a preferred form, divider 66 has a comparable length to that of multiplier 64. This arrangement allows power supply 60 to be constructed in a space efficient manner, such as that appropriate for a hand held device. Output divider 66 includes a third connection 76 for sampling a small percentage of the total output voltage dispersed across divider 66. This small voltage sample is connected to voltage control circuit 68 and used therein for feedback purposes in controlling the voltage at output source 62. Voltage control circuit 68 preferably generates a smooth sine wave voltage for energizing voltage multiplier 64. The elevated voltage produced at output 62 is connected to X-ray source 10 by a heavily insulated cable 78 or by direct connection in an electrically insulating medium such as potting compound or dielectric fluid.

As mentioned, the laser energy produced by laser diode 70 is conveyed by fiber optic cable 24 to X-ray source 10. A diode control circuit 72 controls the amount of energy produced by laser diode 70 and in turn the amount of electron emissions created at cathode 22 (FIG. 1). This method eliminates the need for bulky and highly stressed filament isolation transformers commonly found in conventional grounded target x-ray sources. The use of the fiber optic allows for increased operating voltage potential without change in size or design of the cathode drive system.

Because the power needs of both voltage multiplier 64 and laser diode 70 are limited, power supply 60 may be energized by a battery or equivalent low-voltage power source 74.

Both voltage control circuit 68, laser diode 70 and diode control circuit 72 are located proximally to the low voltage end of voltage multiplier 64. This arrangement minimizes the potential for arcing between voltage multiplier 64 and the other circuit components. Fiber optic cable 24 is shown adjacent to voltage multiplier 64 because cable 24 is non-conductive. This overall arrangement is thus suitable for a space efficient construction, as would be desirable for a hand held device.

It is understood that the X-ray source 10 (FIG. 1) is intended for direct connection with power supply 60 by both fiber optic cable 24 and high voltage cable 78. The length of those elements is not very limited, allowing source 10 to be located remotely from power supply 60.

The present invention is illustratively described above in reference to the disclosed embodiments. Various modifications and changes may be made to the disclosed embodiments by persons skilled in the art without departing from the scope of the present invention as defined in the appended claims.

What is claimed is:

1. An x-ray source, comprising:

an insulating tube having a cylindrical inside surface defining a cylindrical vacuum cavity;

a cathode located near a first end of said insulating tube and adapted to be optically heated for emitting electrons;

an anode adapted for a voltage bias with respect to said cathode for accelerating electrons emitted from said cathode;

an x-ray emitter target located near a second end of said insulating tube for impact by accelerated electrons; and a secondary emission reduction layer covering at least a portion of said inside surface and adapted to minimize charge build-up on said inside surface;

said insulating tube being adapted to be weakly conductive by having a lower resistance layer located between said insulating tube and said secondary emission reduction layer;

said insulating tube being adapted to be weakly conductive to support a uniform voltage gradient along said insulating tube and across said voltage bias between said cathode and said anode.

2. The x-ray source of claim 1, wherein said insulating tube has a conductivity adapted to allow current flow along said insulting tube of approximately ten percent of electron current flow between said cathode and anode under a maximum votage bias there between.

3. The x-ray source of claim 1, wherein said insulating tube has a characteristic resistance, and further wherein said lower resistance layer has a lower resistance than said characteristic resistance to support a sheet current for removing residual charge build-up on said inside surface.

4. The x-ray source of claim 3, wherein said insulating tube is ceramic, and further wherein said lower resistance layer has a resistance value which is scaled to allow a sheet current sufficient to remove residual charge build-up when operating at a desired voltage bias and beam current between said cathode and anode.

5. The x-ray source of claim 1, wherein said lower resistance layer includes refractory oxides.

6. The x-ray source of claim 5 wherein said refractory oxide is at least one oxide selected from aluminum oxide, chromium oxide, titanium oxide, ruthenium oxide, and vanadium oxide.

7. The x-ray source of claim 1, wherein said insulating tube includes a ceramic material formulated to be weakly conductive.

8. The x-ray source of claim 1, wherein said secondary emission reduction layer has a secondary emission coefficient of approximately unity.

9. The x-ray source of claim 1, wherein said secondary emission reduction layer includes oxides.

10. The x-ray source of claim 9 wherein said oxide is at least one oxide selected copper oxide, chromium oxide and silicon oxide.

11. The x-ray source of claim 1, further comprising a first end cover affixed to said first end of said insulating tube and adapted for supporting a vacuum within said vacuum cavity, wherein said first end cover includes a transparent window for admitting optical energy into said vacuum cavity and on to said cathode.

12. The x-ray source of claim 1, further comprising a second end cover affixed to said second end of said insulating tube and adapted for supporting a vacuum within said vacuum cavity, wherein said second end cover includes a window that is transparent to x-ray energy emitted by said target.

13. The x-ray source of claim 1, wherein said insulating tube and said secondary emission reduction and lower resistance layers are adapted to support a voltage potential between said anode and said cathode of at least 20 kV per centimeter along said insulating tube.

14. The x-ray source of claim 1, wherein said insulating tube and said secondary emission reduction and lower resistance layers are adapted to support a voltage potential between said anode and said cathode of at least 50 kV.

15. The x-ray source of claim 1, wherein said insulating tube is less than 2 centimeters long.

16. The x-ray source of claim 1, further comprising a voltage source having:

an elongated voltage multiplier adapted for producing an elevated output voltage for biasing said anode or said cathode;

an elongated, high resistance output divider mounted parallel to said voltage multiplier and connected for sampling said output voltage; and a control circuit adapted to produce an input voltage for said voltage multiplier in response to said output voltage sampled by said output divider, wherein said control circuit is located proximal to a low voltage end of said voltage multiplier and output divider.

17. The x-ray source of claim 16, further comprising;

a laser diode light source adapted to provide energy for heating said cathode; and a diode control circuit adapted to control energy produced by said diode and thereby control electron emissions from said cathode, wherein said diode control circuit is located proximally to said low voltage end of said voltage multiplier.

18. An x-ray source, comprising:

an insulating tube having a cylindrical inside surface defining a cylindrical vacuum cavity;

a cathode located near a first end of said insulating tube and adapted to be optically heated for emitting electrons;

an anode adapted for a voltage bias with respect to said cathode for accelerating electrons emitted from said cathode;

an x-ray emitter target located near a second end of said insulating tube for impact by accelerated electrons;

a secondary emission reduction layer covering at least a portion of said inside surface and adapted to minimize charge build-up on said inside surface;

a first end cover affixed to said first end of said insulating tube and adapted for supporting a vacuum within said vacuum cavity, wherein said first end cover includes a transparent window for admitting optical energy into said vacuum cavity and on to said cathode; and a fiber optic cable adapted for providing optical energy for heating said cathode, wherein said first end cover is adapted to removeably mount one end of said fiber optic cable adjacent to said transparent window for illuminating said cathode.

19. The x-ray source of claim 18, further comprising a laser diode light source coupled to another end of said fiber optic cable.

20. An x-ray source, comprising:

an insulating tube having a cylindrical inside surface defining a cylindrical vacuum cavity;

a cathode located near a first end of said insulating tube and adapted to be optically heated for emitting electrons;

an anode adapted for a voltage bias with respect to said cathode for accelerating electrons emitted from said cathode;

an x-ray emitter target located near a second end of said insulatin tube for impact by accelerated electrons;

a secondary emission reduction layer covering at least a portion of said inside surface and adapted to minimize charge build-up on said inside surface;

said target being electrically isolated from said anode, allowing said anode to intercept and substantially reduce leakage currents, backscattered and field emitted currents.

21. An x-ray source, comprising:

an insulating tube having a cylindrical inside surface defining a cylindrical vacuum cavity;

a cathode located near a first end of said insulating tube and adapted to be optically heated for emitting electrons;

an anode adapted for a voltage bias with respect to said cathode for accelerating electrons emitted from said cathode;

an x-ray emitter target located near a second end of said insulating tube for impact by accelerated electrons;

an elongated voltage multiplier adapted for producing an elevated output voltage for biasing said anode or said cathode;

an elongated, high resistance output divider mounted adjacent and parallel to said voltage multiplier and connected for sampling said output voltage; and a control circuit adapted to produce an input voltage for said voltage multiplier in response to said output voltage sampled by said output divider;

said insulating tube being adapted to be weakly conductive by having a lower resistance layer located between said insulating tube and a secondary emission reduction layer;

said insulating tube being adapted to be weakly conductive to support a uniform voltage gradient along said insulating tube and across said voltage bias between said cathode and said anode;

wherein said control circuit is located proximal to a low voltage end of said voltage multiplier and output divider.

* * * * *

UNITED STATES PATENT AND TRADEMARK OFFICE

CERTIFICATE OF CORRECTION

PATENT NO. : 7,236,568 B2
APPLICATION NO. : 11/087271
DATED : June 26, 2007
INVENTOR(S) : M. T. Dinsmore et al.

It is certified that error appears in the above-identified patent and that said Letters Patent is hereby corrected as shown below:

Column 7
In claim 2, at line 54, replace the word “insulting” with --insulating--.

Column 7
In claim 2, at line 56, replace the word “votage” with --voltage--.

Column 9
In claim 20, at line 35, replace the word “insulatin” with --insulating--.

Signed and Sealed this

Fourteenth Day of August, 2007

JON W. DUDAS
*Director of the United States Patent and Trademark Office*